US006668779B2

(12) United States Patent
Hendriksma et al.

(10) Patent No.: US 6,668,779 B2
(45) Date of Patent: Dec. 30, 2003

(54) TWO-STEP FINGER FOLLOWER ROCKER ARM ASSEMBLY

(75) Inventors: Nick J. Hendriksma, Grand Rapids, MI (US); Andrew J. Lipinski, Rochester, NY (US); Hermes A. Fernandez, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/305,995

(22) Filed: Nov. 27, 2002

(65) Prior Publication Data

US 2003/0209217 A1 Nov. 13, 2003

Related U.S. Application Data

(60) Provisional application No. 60/378,852, filed on May 8, 2002.

(51) Int. Cl.[7] ..... F01L 1/18

(52) U.S. Cl. ..... 123/90.44; 123/90.16

(58) Field of Search ..... 123/90.15, 90.16, 123/90.17, 90.39, 90.4, 90.41, 90.42, 90.43, 90.44, 90.45, 90.46

(56) References Cited

U.S. PATENT DOCUMENTS

| | | | | |
|---|---|---|---|---|
| 4,844,023 A | | 7/1989 | Konno et al. | 123/90.16 |
| 5,463,988 A | | 11/1995 | Paul | 123/90.16 |
| 5,524,580 A | | 6/1996 | Muir | 123/90.16 |
| 5,535,704 A | | 7/1996 | Paul | 123/90.16 |
| 5,584,267 A | | 12/1996 | Muir | 123/90.39 |
| 5,655,488 A | | 8/1997 | Hampton et al. | 123/90.16 |
| 5,697,333 A | | 12/1997 | Church et al. | 123/90.16 |
| 5,775,280 A | * | 7/1998 | Schmidt et al. | 123/90.41 |

* cited by examiner

*Primary Examiner*—Thomas Denion
*Assistant Examiner*—Jaime Corrigan
(74) *Attorney, Agent, or Firm*—Patrick M. Griffin

(57) ABSTRACT

A two-step finger follower rocker arm assembly for cooperating with high-lift and low-lift cam lobes of an engine camshaft. The rocker arm assembly includes a follower body for engaging an hydraulic lash adjuster and a valve stem. A central well contains a roller for following the central low-lift cam lobe. Pivotably mounted on the body are lateral high-lift followers, including sliders or rollers, for following the lateral high-lift cam lobes. A latch block disposed on the body surface is slidable by piston and spring means between first and second positions to engage and thereby alternatively latch and unlatch the high-lift followers. In latched position, the rocker arm assembly acts in high-lift mode; in unlatched position, in low-lift mode.

21 Claims, 7 Drawing Sheets

TWO-STEP FINGER FOLLOWER ROCKER ARM ASSEMBLY

RELATIONSHIP TO OTHER APPLICATIONS AND PATENTS

The present application claims the benefit of U.S. Provisional Application, Ser. No. 60/378,852, filed May 8, 2002.

TECHNICAL FIELD

The present invention relates to mechanisms for altering the actuation of valves in internal combustion engines; more particularly, to finger follower type rocker arms having means for changing between high and low or no valve lifts; and most particularly, to a two-step finger follower type rocker arm assembly, having a fixed central cam follower and a pair of pivotable lateral cam followers disposed on the finger follower body, and having locking means for latching and unlatching the lateral cam followers from the finger follower body to shift between high lift and low lift modes.

BACKGROUND OF THE INVENTION

Variable valve activation (VVA) mechanisms for internal combustion engines are well known. It is known to be desirable to lower the lift, or even to provide no lift at all, of one or more valves of a multiple-cylinder engine, especially intake valves, during periods of light engine load. Such deactivation can substantially improve fuel efficiency.

Various approaches have been disclosed for changing the lift of valves in a running engine. One known approach is to provide an intermediary cam follower arrangement which is rotatable about the engine camshaft and is capable of changing both the valve lift and timing, the cam shaft typically having both high-lift and low-lift lobes for each such valve. Such an arrangement can be complicated and costly to manufacture and difficult to install onto a camshaft during engine assembly.

Another known approach is to provide a deactivation mechanism in the hydraulic lash adjuster (HLA) upon which a cam follower rocker arm pivots. Such an arrangement is advantageous in that it can provide variable lift from a single cam lobe by making the HLA either competent or incompetent to transfer the motion of the cam eccentric to the valve stem. A shortcoming of providing deactivation at the HLA end of a rocker arm is that, because the cam lobe actuates the rocker near its longitudinal center point, the variation in lift produced at the valve-actuating end can be only about one-half of the extent of travel of the HLA deactivation mechanism.

Still another known approach is to provide a deactivation mechanism in the valve-actuating end of a rocker arm cam follower (opposite from the HLA pivot end) which locks and unlocks the valve actuator portion from the follower body. Unlike the HLA deactivation approach, this approach typically requires both high-lift and low-lift cam lobes to provide variable lift.

U.S. Pat. No. 5,655,488 issued Aug. 12, 1997, discloses a system including an inner rocker arm in engagement with a valve and with a first cam, an outer rocker arm in engagement with a second cam, and a latch member which is insertable between the rocker arms. A significant drawback of the disclosed apparatus is that the latching mechanism is a relatively large box-like member which "essentially surrounds" the outer rocker arms, thereby increasing undesirably the mass and inertia of the rocker assembly. Another drawback is that its outer rocker arms are inter-connected and move in unison thereby increasing the mass and inertia of the moving members.

It is a principal object of the present invention to provide a simplified variable valve lift apparatus.

It is a further object of the invention to provide an increased range of motion between a high lift and a low lift position of an engine valve.

SUMMARY OF THE INVENTION

Briefly described, a two-step finger follower rocker arm assembly in accordance with the invention is configured to cooperate with an engine camshaft having both high-lift and low-lift cam lobes. For each valve of the valve train equipped with the present rocker arm assembly, a central low-lift cam lobe is accompanied by at least one high-lift lobe and preferably is flanked symmetrically by a pair of lateral high-lift lobes.

The present rocker arm assembly includes an elongate, rigid follower body that has a socket at a first end for engaging a conventional hydraulic lash adjuster as a pivot means, and that has an arcuate pad at a second and opposite end for engaging a valve stem or lifter means. A central well or passage through the follower body contains means, preferably in the form of a fixed slider or roller, for following the central low-lift cam lobe to provide low-lift of the valve when engaged therewith. Outboard of the follower body and pivotably mounted thereupon are first and second lateral high-lift followers, including sliders or rollers, for following the lateral high-lift lobes to provide high-lift of the valve. A latch block disposed on the body is slidable by piston and spring means between first and second positions to alternatively latch and unlatch the high-lift followers. In latched position, the rocker arm assembly acts in high-lift mode; in unlatched position, in low-lift mode.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
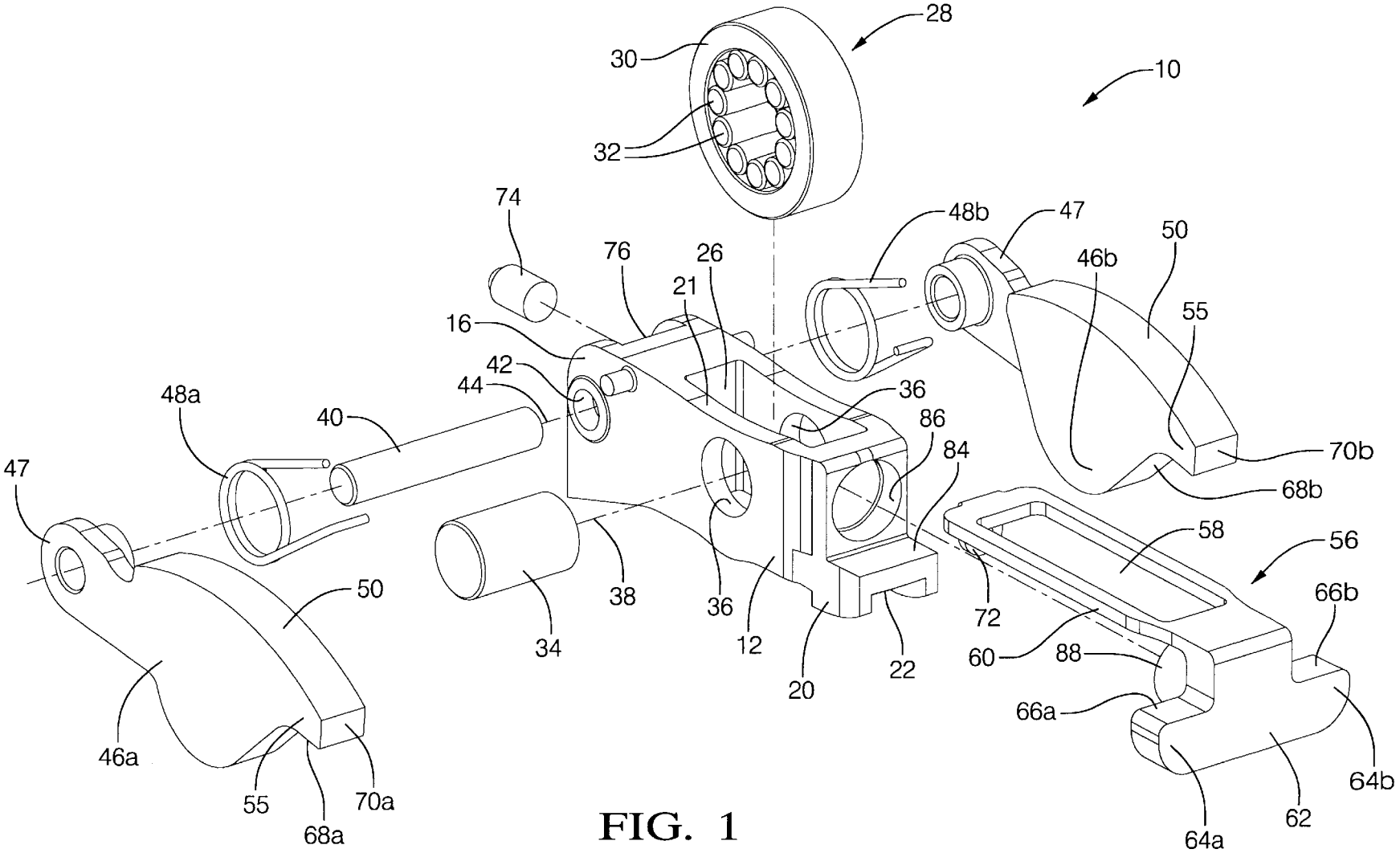
FIG. 1 is an exploded isometric view from a first direction of a first embodiment of a two-step finger follower rocker arm assembly in accordance with the invention.

A two-step finger follower rocker arm assembly in accordance with the invention is configured to cooperate with an engine camshaft having both high-lift and low-lift cam lobes. For each valve of the valve train equipped with the present rocker arm assembly, a low-lift cam lobe is accompanied by at least one high-lift lobe. In the description below, the rocker arm assembly is configured to cooperate with a cam arrangement wherein a central low-lift lobe is flanked symmetrically by a pair of lateral high-lift lobes.

Referring to FIGS. 1 through 4, a first embodiment 10 of a two-step finger follower rocker arm assembly used in internal combustion engine 17 in accordance with the invention includes a longitudinal follower body 12 having spherical socket 14 at a first end 16 for pivotably mounting onto an engine pivot means such as a conventional hydraulic lash adjuster (HLA) 18. At a second end 20 of body 12 is an arcuate pad 22 for engaging and actuating a valve stem 24 or other valve-actuation linkage such as a lifter. An upper surface 21 of body 12 is provided with means for following a central low-lift cam lobe 23 of camshaft 27. Such means may comprise a conventional slider surface (not shown), but is preferably a vertically transverse well or passage 26 in body 12 containing a conventional roller bearing assembly 28 comprising an outer race 30 and roller or needle bearings 32. Bearing assembly 28 is rotatably supported in well 26 by a first cross-shaft 34 fixedly disposed in first bores 36 in body 12 along first axis 38.

Figure 2:
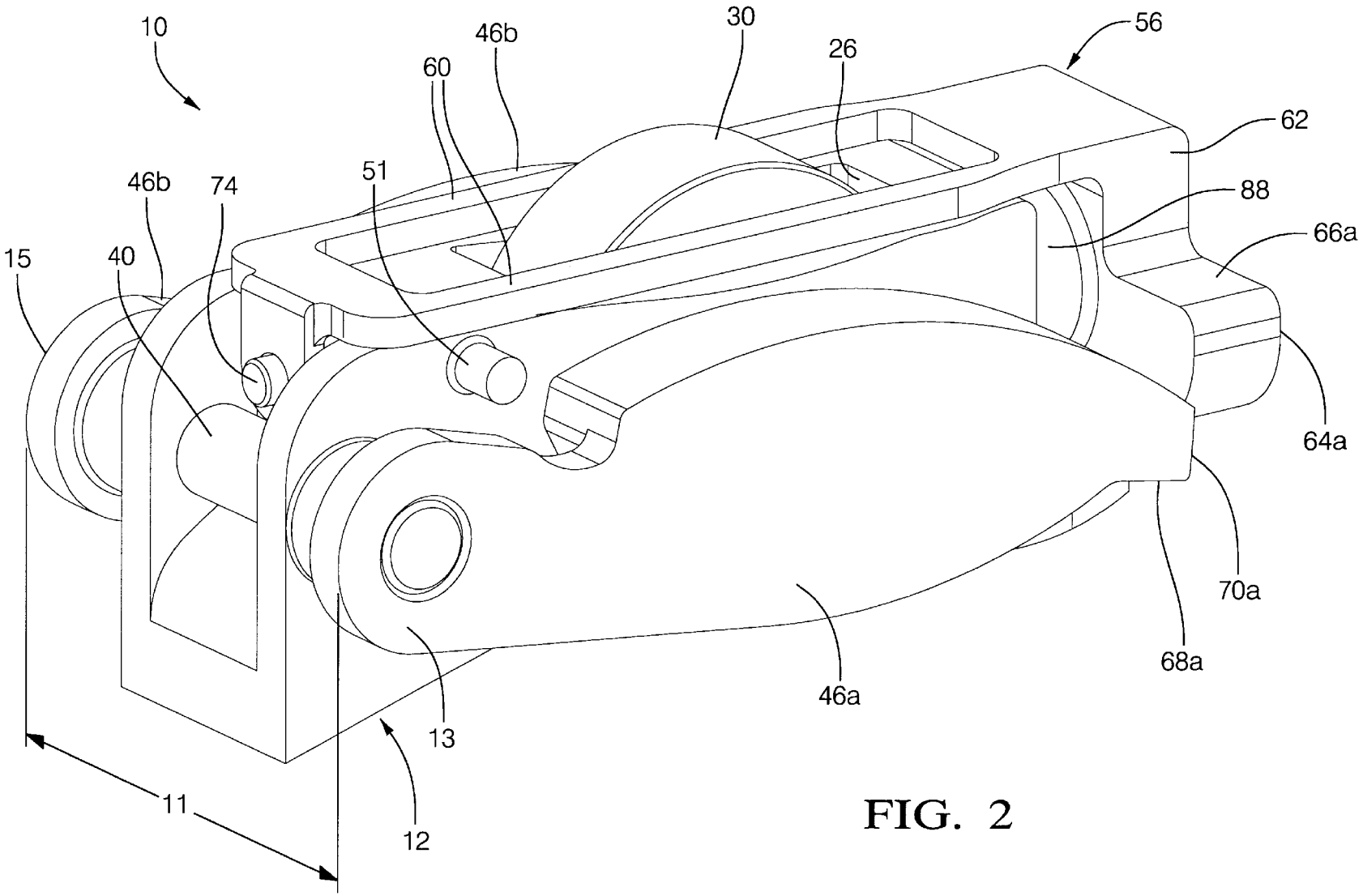
FIG. 2 is an isometric view of the rocker arm assembly shown in FIG. 1 after assembly and taken from a second direction, showing lateral followers in unlatched position, the assembly being in low-lift mode.
Figure 3:
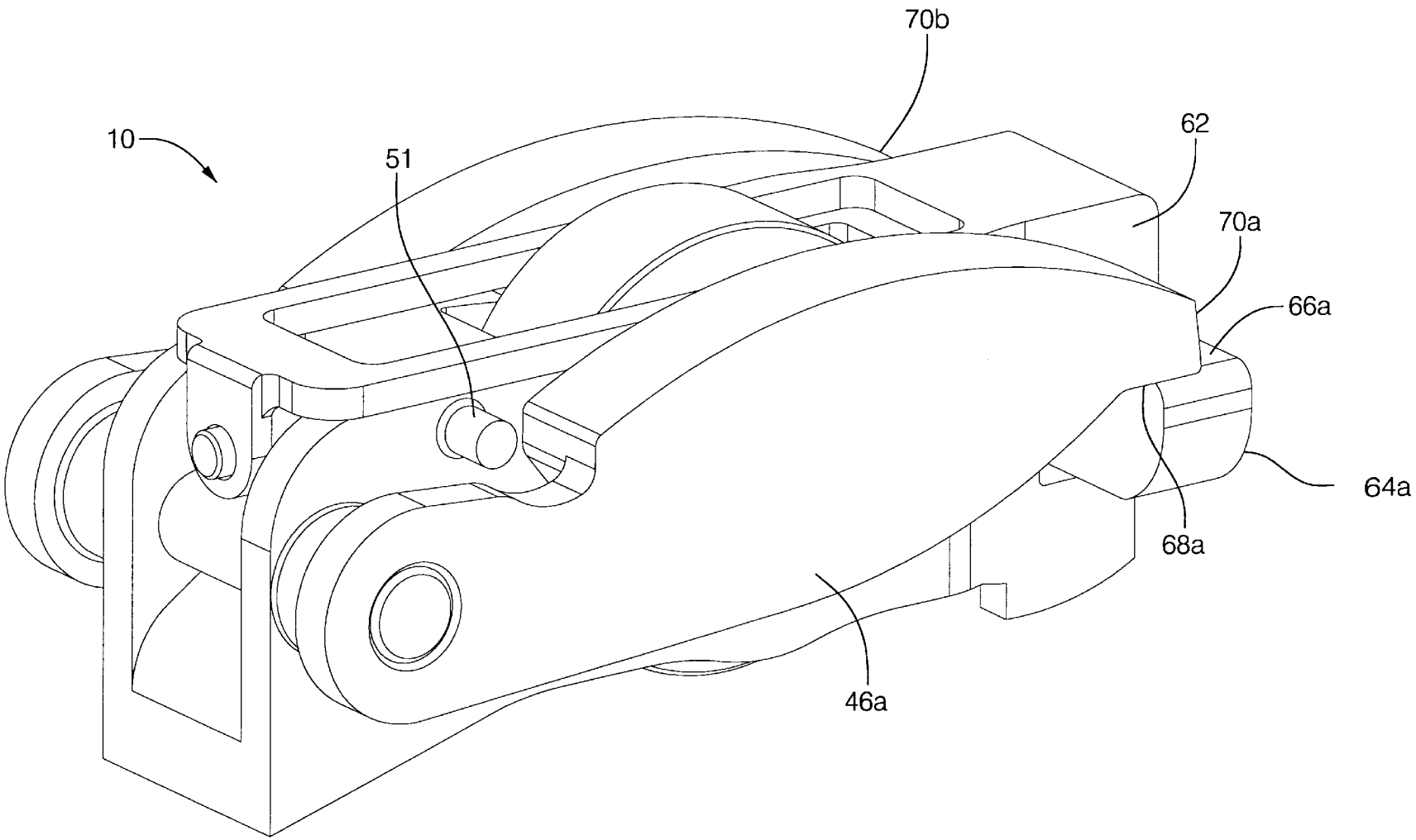
FIG. 3 is an isometric view like that shown in FIG. 2, showing the followers in latched position, the assembly being in high-lift mode.
Figure 4:
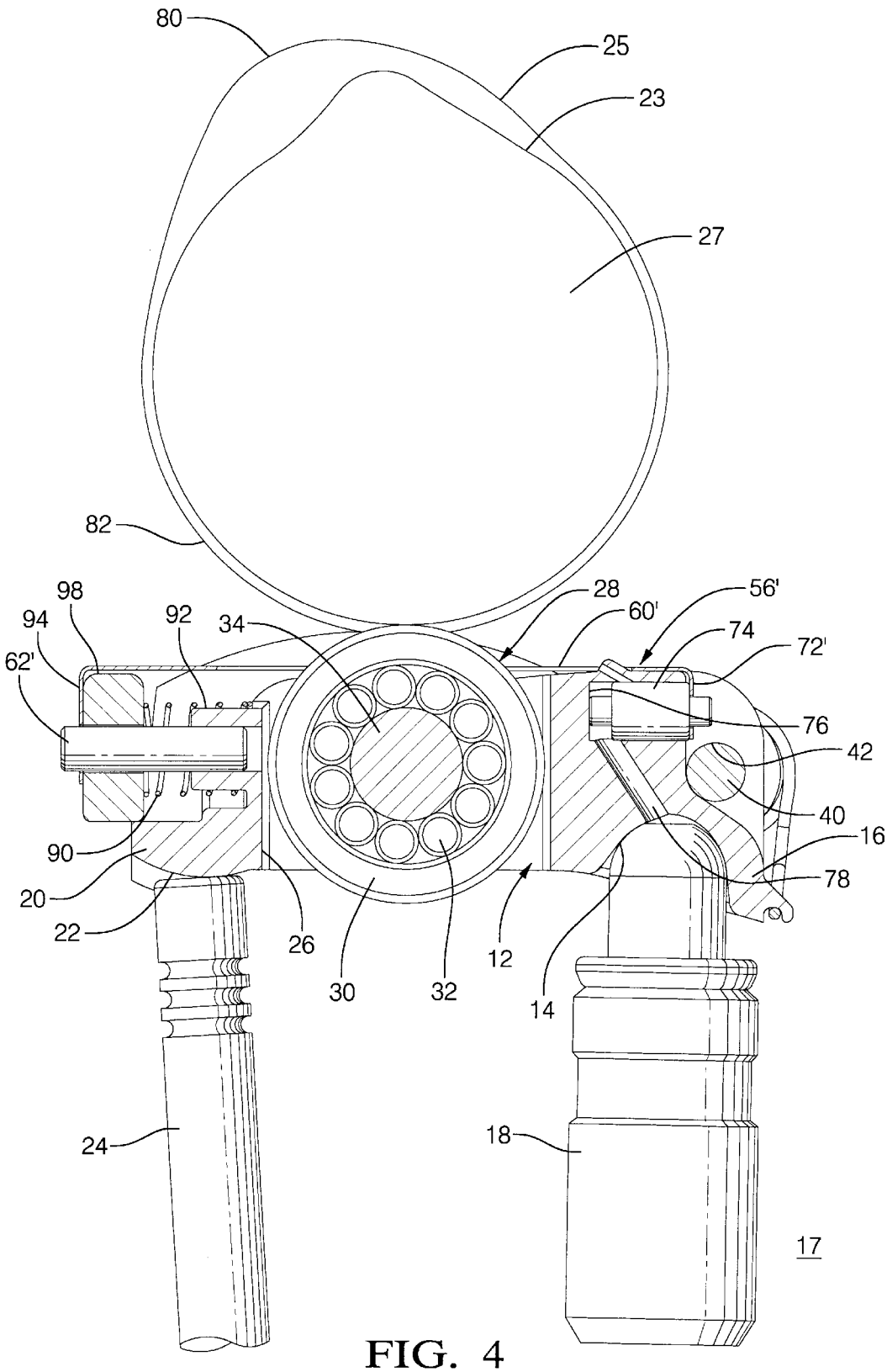
FIG. 4 is an elevational cross-sectional view of a second embodiment of a rocker arm assembly similar to the assembly shown in FIGS. 1 through 3 but including a guide pin for alignment of the latch block during actuation thereof, installed schematically in an internal combustion engine.
Figure 7:
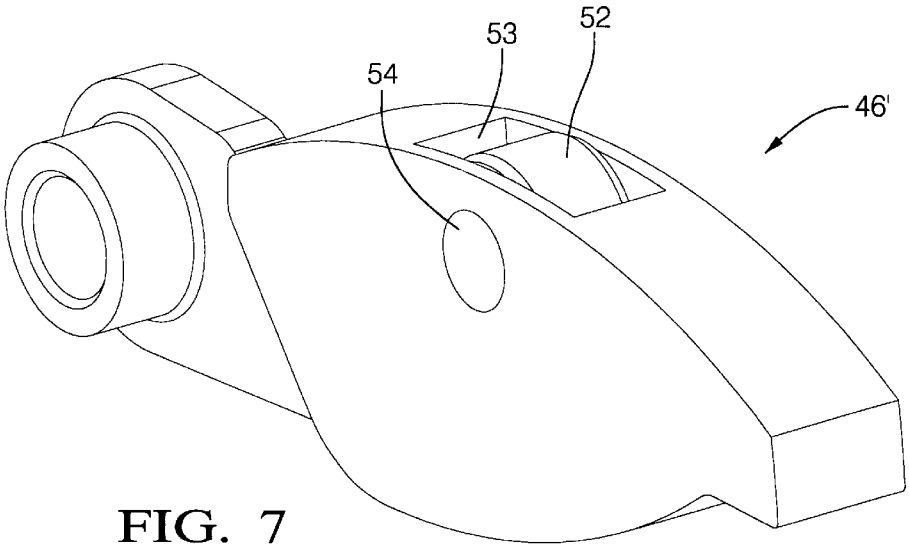
FIG. 7 is an isometric view of a second embodiment of a lateral follower.

A second cross-shaft 40 is disposed in second bores 42 in body 12 along a second axis 44 parallel to first axis 38. Shaft 40 extends beyond body 12 to support first and second lateral high-lift cam followers 46*a*,46*b* at a first end 47 thereof. Between followers 46*a*,46*b* and body 12 are disposed lost motion springs 48*a*,48*b*, respectively, which urge followers 46*a*,46*b* in a counter-clockwise direction, as seen in FIGS. 1 through 3, to maintain contact between the followers and high-lift cam lobes 25 (FIG. 4). Cam followers 46*a*,46*b* may be fixedly attached to shaft 40, and shaft 40 may be provided with bearings (not shown) in known fashion such that shaft 40 is rotatable in bore 42; or the shaft may be fixed in the bore and the cam followers provided with bearings for rotation thereupon, to equal effect. Lateral cam followers 46*a*,46*b* are preferably provided with curved upper surfaces 50 for following high-lift lobes 25; however, if desired, either or both of the followers (46') may be modified as shown in FIG. 7 to include a roller 52 disposed in a well 53 on a cross shaft 54. In either case, the maximum width of assembly 10 is defined by the distance 11 along shaft 40 between respective first and second outer surfaces 13,15 (FIG. 2) of lateral followers 46*a*,46*b*, which coincides with the axial direction of cam lobes 23,25.

A longitudinal latch block 56 is formed to slide along upper surface 21 of body 12. Block 56 has a central opening 58 in slider element 60 to accommodate bearing assembly 28 protruding through and further has a latching head 62 extending substantially orthogonally from the plane of element 60. 30 Latching head 62 is formed having first and second latches 64*a*,64*b* extending into the rotary plane of actuation of lateral followers 46*a*,46*b*, respectively, and having first and second latching surfaces 66*a*,66*b* for latchingly engaging mating latching surfaces 68*a*,68*b* on noses 70*a*,70*b* of followers 46*a*,46*b* when the latches are moved into interference with the noses, said noses being formed at respective second ends 55 of said lateral followers.

Latch block 56 is further provided with a yoke 72 extending orthogonally from element 60 for capturing and retaining an actuating piston assembly 74 in a recess 76 in body 12, as shown in FIG. 4. Recess 76 is connected via passage 78 to hollow hydraulic lash adjuster 18, whereby pressurized oil may be supplied to piston assembly 74 as desired to urge latch block 56 along surface 21 and latching head 62 toward body 12. At the outward extent of piston travel, latches 64*a*,64*b* are brought into interference with noses 70*a*,70*b*. If lateral followers 46*a*,46*b* are depressed, as shown in FIG. 2, by being temporarily engaged with the eccentric portion 80 of high-lift lobes 25, then the latches are temporarily biased against the noses. When lobes 25 rotate such that eccentric portions 80 of high lift lobes 25 move away from follower surfaces 50 of followers 46*a*,46*b*, lost motion springs 48*a*, 48*b* raise the followers into latching position and the piston bias slides latching surfaces 66*a*,66*b* of latches 64*a*,64*b* into latching relationship with latching surfaces 68*a*,68*b* of noses 70*a*,70*b* (FIG. 3). Body 12 preferably is provided with a shelf extension 84 (FIG.1) for supporting latching head 62. Preferably, body 12 is further provided with an end bore 86 and latch block 56 is provided with an alignment stud 88 to align the latching head during latching movement of the latch block. Stud 88 is slidingly entered into bore 86 at all positions of travel of latching head 62. A return spring 90 (omitted for clarity from FIG. 1 but shown in FIG. 5) is disposed in compression between latching head 62 and body 12 to unlatch the assembly when pressure is reduced from piston assembly 74. When the lateral high-lift followers are unlatched, they continue to follow the high-lift cam lobe through lost motion. However, as eccentric portions 80 move away from surfaces 50 of followers 46*a*,46*b*, travel stop pins 51 (only one shown in FIG. 3) restrict counter clockwise rotation of lateral followers 46*a*,46*b* thereby preventing follower surfaces 50 of followers 46*a*,46*b* from remaining in contact with base circle portions 82 of high lift cam lobes 25. This momentary break from contact with surfaces 50 facilitates distribution of lubricating oil to the mating surfaces.

Figure 1A:
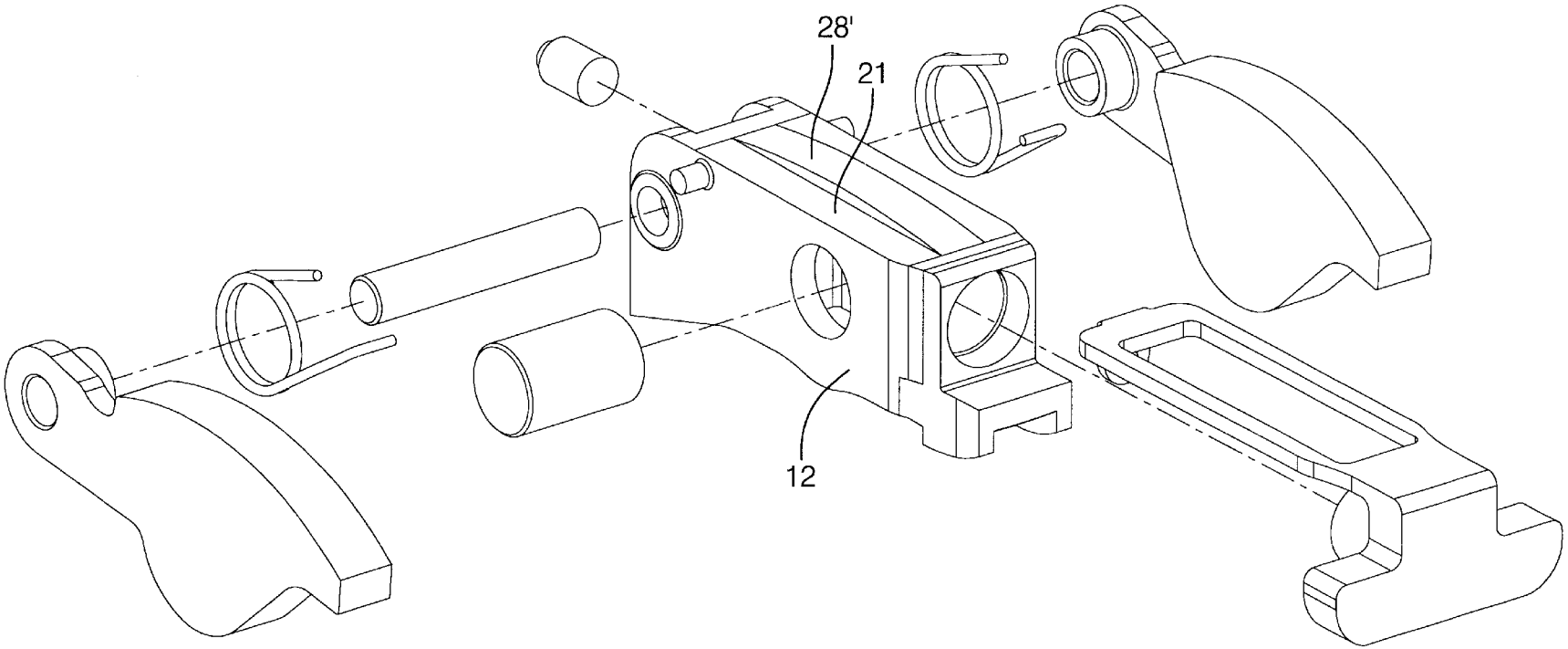
FIG. 1*a* is a view like that shown in FIG. 1 showing a second embodiment of a central follower means.

Referring to FIG. 1*a*, in some applications it can be desirable to substitute a simple fixed central slider surface 28' for roller assembly 28 in providing for engagement with central cam lobe 23.

Figure 5:
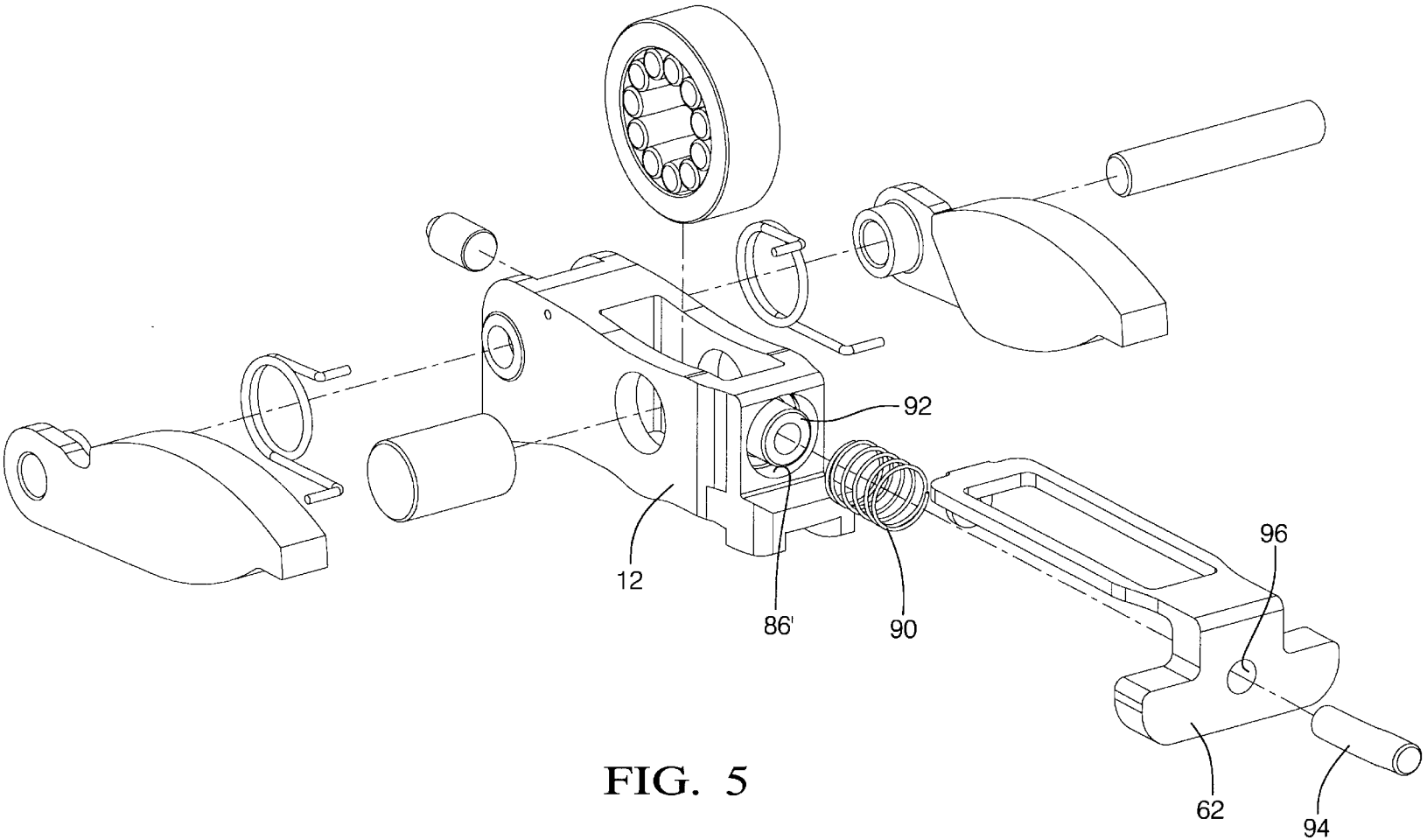
FIG. 5 is an exploded isometric view from the first direction of the second embodiment shown in FIG. 4.
Figure 6:
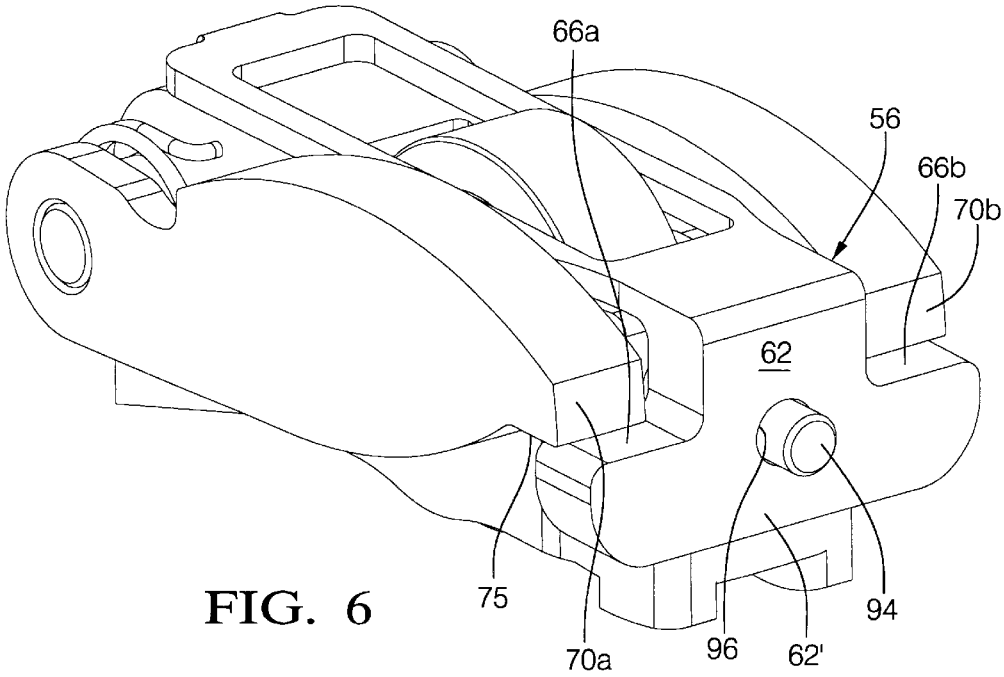
FIG. 6 is an isometric view of the rocker arm assembly shown in FIG. 5 after assembly.

Referring to FIGS. 4 through 6, in an alternative embodiment of an alignment arrangement, end bore 86' includes a boss 92 for centering and retaining an alignment pin 94 that extends through a mating alignment bore 96 in latching head 62. Referring to FIG. 4, in an alternative embodiment of a latch block, latch block 56' is provided in two separate and inexpensive components. A slider element 60' is formed as by stamping from sheet metal and includes a first integral yoke 72' for retaining piston assembly 74 and a second integral yoke 98 for retaining a separate latching head 62' held in place against yoke 98 by return spring 90.

In all of the various embodiments and arrangements, an important consideration is that the two lateral followers both latch with certainty. If either one fails to latch when the other does, substantial damaging torque may be applied to the assembly 10. This can happen when the locking head is just starting to engage the lateral followers when the high-lift event begins. If there is not enough or only partial engagement, one or both of the lateral followers can slip off the locking head. This is known in the art as an "ejection." To counteract this, preferably the noses 70*a*,70*b* of the lateral followers are radiused 75 in such a way (FIG. 6) that if one of the followers ejects, it will push the locking head back and cause the other arm to eject as well.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A two-step finger follower rocker arm assembly for variably activating a gas valve of in an internal combustion engine having a camshaft having a central lobe and at least one lateral lobe adjacent a first side of the central lobe, comprising:

a) a follower body having means for engaging said engine at a first end of said body and having means for engaging a valve stem of said gas valve at a second end of said body;

b) central follower means disposed on said body for engaging said central lobe;

c) first lateral follower means pivotably disposed outside said follower body on a shaft extending from said body and including means for engaging said at least one lateral cam lobe; and d) latching means disposed on said follower body for latching said lateral follower means to said body, said latching means including a slider element slidingly disposed on a surface of said body inboard of said lateral follower means and including a latching head for selectively engaging said lateral follower means to cause the motion of said at least one lateral cam lobe to be translated to said body in a first rocker assembly mode having a first valve lift capability, and for unlatching said lateral follower means from said body to cause engagement of said central follower with said central camshaft lobe to provide a second rocker assembly mode having a second valve lift capability.

2. A rocker arm assembly in accordance with claim 1, wherein said at least one lateral lobe includes a second lateral cam lobe disposed adjacent a second and opposite side of said central cam lobe, wherein said assembly comprises a second lateral follower means pivotably disposed outside said follower body on said shaft extending from said body and including means for engaging said second lateral cam lobe, said latching head being formed for selectively engaging both of said first and second lateral followers.

3. A rocker arm assembly in accordance with claim 2 wherein said first and second lateral followers further comprise first and second outer surfaces, respectively, spaced apart by a distance along said shaft, said distance being the maximum dimension of said assembly in a direction along said engine camshaft.

4. A rocker arm assembly in accordance with claim 1 wherein said means for engaging said central cam lobe comprises a slider surface.

5. A rocker arm assembly in accordance with claim 1 wherein said means for engaging said central cam lobe comprises a central passage formed in said body and a central roller rotatably disposed in said central passage.

6. A rocker arm assembly in accordance with claim 1 wherein said means for engaging said lateral cam lobe comprises a slider surface.

7. A rocker arm assembly in accordance with claim 1 wherein said means for engaging said lateral cam lobe comprises a well formed in said lateral follower and a central roller rotatably disposed in said well.

8. A rocker arm assembly in accordance with claim 1 wherein said shaft is rotatably mounted in a bore of said body.

9. A rocker arm assembly in accordance with claim 8 further comprising bearing means disposed between said shaft and said follower body.

10. A rocker arm assembly in accordance with claim 1 wherein said shaft is fixedly mounted in a bore of said body.

11. A rocker arm assembly in accordance with claim 10 further comprising bearing means disposed between said shaft and said lateral follower means.

12. A rocker arm assembly in accordance with claim 1 further comprising a return spring disposed on said shaft between said body and said lateral follower means.

13. A rocker arm assembly in accordance with claim 1 further comprising an end bore formed in said body and an alignment stud formed on said latching head for guiding said latching head during said latching and unlatching.

14. A rocker arm assembly in accordance with claim 1 further comprising an alignment pin protruding from said body and an alignment bore in said latching head for receiving said alignment stud for guiding said latching head during said latching and unlatching.

15. A rocker arm assembly in accordance with claim 1 further comprising a piston assembly disposed between said body and said latch block for urging said latching head into selective engagement with said lateral follower means.

16. A rocker arm assembly in accordance with claim 15 further comprising a return spring disposed between said body and said latch block for urging said latching head into selective disengagement with said lateral follower means.

17. A rocker arm assembly in accordance with claim 1 wherein said central cam follower means acts to provide low valve lift and said lateral follower means acts to provide high valve lift.

18. A rocker assembly in accordance with claim 1 wherein said first lateral follower means includes a nose for latching engagement with said latching head, said nose further including a radius to push said locking head back upon partial engagement with said nose.

19. A rocker assembly in accordance with claim 1 further including at least one travel stop pin for limiting a pivoting travel of said lateral follower means when said lateral follower means is unlatched.

20. A multiple-cylinder internal combustion engine having a camshaft having a central lobe and first and second lateral lobes flanking the central lobe, the engine comprising a two-step finger follower rocker arm assembly for variably activating a gas valve therein, said assembly including a follower body having means for engaging said engine at a first end of said body and having means for engaging a stem of said gas valve at a second end of said body, central follower means disposed on said body for engaging said central lobe, first and second lateral follower means pivotably disposed outside said follower body on a shaft extending from said body and including means for engaging said first and second lateral cam lobes, and latching means disposed on said follower body for latching said first and second lateral follower means to said body, said latching means including a slider element slidingly disposed on a surface of said body between said first and second lateral follower means and including a latching head for selectively engaging said first and second lateral follower means to cause the motion of said lateral cam lobes to be translated to said body in a first rocker assembly mode having a first valve lift capability, and for unlatching said lateral follower means from said body to cause engagement of said central follower with said central camshaft lobe to provide a second rocker assembly mode having a second valve lift capability.

21. A two-step finger follower rocker arm assembly for variably activating a gas valve in an internal combustion engine, said assembly comprising:

a) a follower body having means for engaging said engine at a first end of said body and having means for engaging a stem of said gas valve at a second end of said body;

b) central follower means disposed on said body for engaging said central lobe;

c) first and second lateral follower means pivotably disposed outside said follower body on a shaft extending from said body and including means for engaging said first and second lateral cam lobes; and d) latching means disposed on said follower body for latching said first and second lateral follower means to said body, said latching means including a slider element slidingly disposed on a surface of said body between said first and second lateral follower means and including a latching head for selectively engaging said first and second lateral follower means to cause the motion of said lateral cam lobes to be translated to said body in a first rocker assembly mode having a first valve lift capability, and for unlatching said lateral follower means from said body to cause engagement of said central follower with said central camshaft lobe to provide a second rocker assembly mode having a second valve lift capability.

* * * * *